US006655333B2

(12) United States Patent
Seitz et al.

(10) Patent No.: US 6,655,333 B2
(45) Date of Patent: Dec. 2, 2003

(54) VALVE TRAIN OF AN INTERNAL COMBUSTION ENGINE COMPRISING ONE OR MORE SWITCHABLE SUPPORT ELEMENTS

(75) Inventors: Joachim Seitz, Reundorf (DE); Michael Haas, Weisendorf (DE); Bodo Rörig, Weisendorf (DE); Dicter Schmidt, Nürnberg (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/997,637

(22) Filed: Nov. 29, 2001

(65) Prior Publication Data

US 2003/0111034 A1 Jun. 19, 2003

(51) Int. Cl.[7] ..... F01L 1/14

(52) U.S. Cl. ..... 123/90.52; 123/90.27; 123/90.31; 123/90.48

(58) Field of Search ..... 123/90.27, 90.31, 123/90.16, 90.48, 90.52

(56) References Cited

U.S. PATENT DOCUMENTS

| | | | | | |
|---|---|---|---|---|---|
| 4,151,817 | A | * | 5/1979 | Mueller | 123/90.16 |
| 4,481,919 | A | | 11/1984 | Honda et al. | 123/198 F |
| 5,546,899 | A | * | 8/1996 | Sperling et al. | 123/90.5 |
| 5,669,342 | A | * | 9/1997 | Speil | 123/90.16 |
| 5,960,756 | A | * | 10/1999 | Miyachi et al. | 123/90.16 |
| 6,053,135 | A | * | 4/2000 | Ochiai et al. | 123/90.16 |
| 6,314,927 | B1 | * | 11/2001 | Schnell | 123/90.16 |

FOREIGN PATENT DOCUMENTS

| | | |
|---|---|---|
| DE | 285120 | 6/1915 |
| DE | 291452 | 4/1916 |
| DE | 4025124 | 2/1992 |
| DE | 19914046 | 9/2000 |
| WO | 8700238 | 1/1987 |

* cited by examiner

*Primary Examiner*—Thomas Denion
*Assistant Examiner*—Ching Chang
(74) *Attorney, Agent, or Firm*—Muserlian, Lucas and Mercanti

(57) ABSTRACT

In a valve train of an internal combustion engine having a switchable support element (1), the lost motion spring (18) of the support element (1) is arranged axially offset next to the support element (1) while being coupled to an inner element (3) of the support element (1) by a crossbar (20). Due to this externally positioned spring (18), the support element (1) requires only a relatively small design space.

7 Claims, 2 Drawing Sheets

VALVE TRAIN OF AN INTERNAL COMBUSTION ENGINE COMPRISING ONE OR MORE SWITCHABLE SUPPORT ELEMENTS

FIELD OF THE INVENTION

The invention concerns a valve train of an internal combustion engine, said valve train comprising one or more switchable support elements that are arranged with an inner element for relative axial displacement in a reception of a cylinder head of the internal combustion engine, which inner element extends beyond the reception by a head comprising a support for a finger lever, a coupling means for a selective coupling of the inner element relative to the reception in an axially extended state of the inner element out of the reception being associated to the support element, while the inner element is biased away from the reception by at least one spring.

BACKGROUND OF THE INVENTION

A generic valve train of the pre-cited type is disclosed in DE 44 22 340 A1. This valve train has the inherent drawback that its support element has a relatively large overall height. As a person skilled in the art will see from the figure, due to the compression spring being arranged under the inner element, a considerably large design space is required. If such a support element is to be integrated, for example, into existing engine designs, its relatively large height can lead to design space problems. Also, it is often not possible to deepen the reception bore for the support element in the cylinder head because one would penetrate into the region of inlet, outlet and cooling channels or the like.

Other known switchable support elements have a relatively large overall width due to their special concentric spring arrangement, or due to other design features.

OBJECTS OF THE INVENTION

It is an object of the invention to provide a valve train of the pre-cited type in which the aforesaid drawbacks are eliminated.

This and other objects and advantages of the invention will become obvious from the following detailed description.

SUMMARY OF THE INVENTION

The invention achieves the above objects by the fact that the spring is arranged axially offset next to the support element and is coupled to the inner element by a crossbar.

Alternatively, the invention achieves the above objects in an embodiment comprising two support elements by the fact that the two support elements are loaded by a common spring that extends at least substantially outside of the support elements.

The design space problems discussed above are eliminated in a simple manner by the measures proposed by the invention.

Thus, the invention proposes a valve train comprising at least one or, alternatively, two support elements, that require only a small design space and can therefore be integrated in most cases into existing engine designs. As a result, engine manufacturers do not need to make complicated modifications to the overall design of the engines. Distances once defined, for instance the distance of the camshaft axis from the crankshaft axis, can be retained.

In particular, due to the external and laterally offset arrangement of the spring, the proposed valve train including the support elements is relatively flat compared to prior art configurations, for example, compared also to that disclosed in DE 197 105 78 A1.

It is conceivable to use a variety of spring elements such as flat coil springs and torque rods, but also pneumatic or magnetic and other similar means. Due to the design space freedom obtained by the external positioning of the springs, it is possible to realize higher spring forces. In the uncoupled state of the support element, this also enables a reliable lost motion stroke of the inner element at high to very high engine speeds.

Although it is conceivable to use only one guide column and a single spring acting through a leg on the inner element, it is better to use at least two diametrically opposed guide columns with corresponding springs and have the inner element extend between these. By this measure, tilting and other similar accompanying negative effects are excluded.

Advantageously, according to a further feature of the invention, the springs surround the guide columns. However, it is also conceivable to use inter-inserted arrangements of the springs which, as proposed by way of example, can be configured as coil or flat coil springs.

The invention further proposes a simple means for connecting the crossbar to the inner element, viz., the crossbar surrounds the inner element quasi in the manner of spectacles. Alternatively, it is proposed to divide the crossbar and realize an engagement on the inner element through the two opposing legs of the crossbar thus obtained. Simple driving elements can be provided on the inner element, for example, in the form of circlips, annular extensions and the like.

If, for example, there are design space problems, but also to minimize costs, at least two support elements can be loaded by a single crossbar. A loading of the crossbar through the springs is preferably effected on the ends of the crossbar. If need be, even a central region of the crossbar situated between two support elements can be additionally loaded by a spring, and an additional guide column can also be provided for this spring.

As briefly mentioned above, in an alternative solution offered by the invention, two support elements can also be loaded by a common spring that can have a crossbar-type of geometry. According to an advantageous feature of the invention, the spring is made as a leaf spring or a stack of leaf springs. This measure is relatively inexpensive to realize and the mounting proves to be relatively simple. The upper front ends of the leaf spring can act on the inner elements of the two support elements in a direction to push them outwards.

It is proposed at the same time to hold a central region of the layers of the spring together by a connecting element such as a rivet. If need be, this rivet can sit on the cylinder head. This results in the creation of a quasi divided leaf spring stack.

Lower front ends of the leaf spring can be optionally supported on an edge of a housing for the inner element, or on a support on the cylinder head.

Although it is conceivable to let the inner element slide directly in the reception of the cylinder head, the invention advantageously proposes a housing that is fixed directly in the reception of the cylinder head.

For an indirect coupling of the inner element to the cylinder head, the invention proposes mechanical means, not further specified, such as pistons, balls, pins etc. These can be loaded in at least one direction of displacement by a hydraulic medium.

Finally, it is proposed to provide valve lash adjusting measures on the support element in the valve train. For example, each support element can comprise a hydraulic lash adjuster, known per se. This renders complicated mechanical adjusting measures adapted to defined operation cycles of the internal combustion engine superfluous.

The invention will now described with reference to the appended drawings.

DETAILED DESCRIPTION OF THE DRAWINGS

Figure 1:
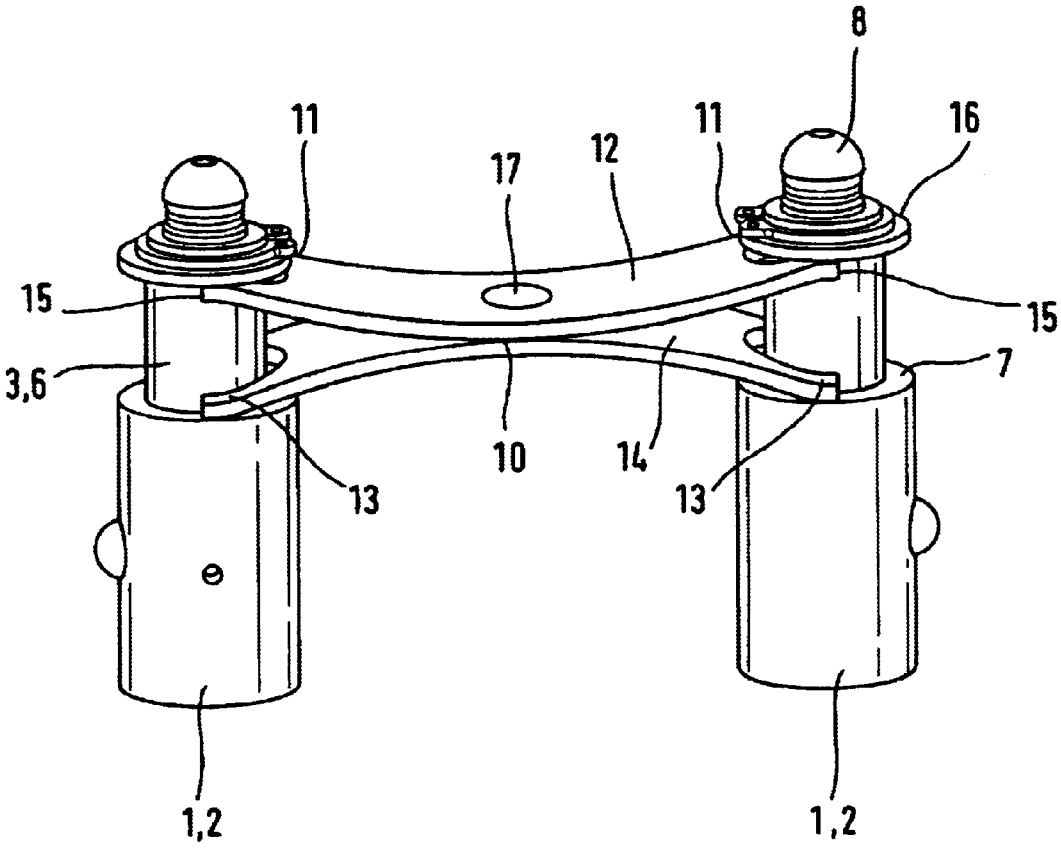
FIG. 1 shows a perspective view of a valve train of the invention having two support elements and one spring.

FIG. 1 discloses two support elements 1 of a valve train of an internal combustion engine. Each support element 1 comprises a housing 2 in which an inner element 3 is installed for axial displacement. The housing 2 (see also FIGS. 2 and 3) is fixed in a reception 4 of a cylinder head 5.

The inner element 3 extends with its head 6 beyond an edge 7 of the housing 2 in a direction leading away from the reception 4. On its end, the inner element 3 comprises a support 8 for one end of a finger lever. Each support element comprises, as roughly indicated in FIGS. 2, 3, a coupling means 9 which does not need to be elucidated further in this context.

Between the two support elements 1 shown in FIG. 1, there is arranged a spring 10 of the invention. This is made as a leaf spring and connects the two support elements 1 in the manner of a crossbar. Ends 11 of the upper layer 12 of the spring 10 point away from ends 13 of a lower layer 14 of the spring 10. Each front end 15 of the layer 12 engages under a stop means 16 which is configured as a circlip and arranged on the head 6 of each inner element 3.

The lower ends 13 are supported on the edge 7 of the housing 2. A central region of the layers 12, 14 is held together by a connecting means 17 such as a rivet. This can, but must not be supported on the cylinder head 5.

The ends 11, 13 of the layers 12, 14 are bifurcated and engage around the respective inner element 3 at least segment-wise with their thus formed forked regions. It is, however, also conceivable to have the ends 11, 13 surround the inner element 3 all round.

The spring 10 is configured as a so-called lost motion spring. As described above, in the prior art, this spring is arranged within the housing and configured, as a rule, as a coil spring. This can lead to design space problems. Due to the external positioning of the spring 10 of the invention in all the embodiments, including those still to be described, the support element 1 requires no, or no significantly larger design space than non-switchable prior art support elements. At the same time, the spring forces can be increased, if required, so that a reliable lost motion stroke of the inner element 3 is guaranteed at high rotary speeds in its uncoupled state.

Figure 2:
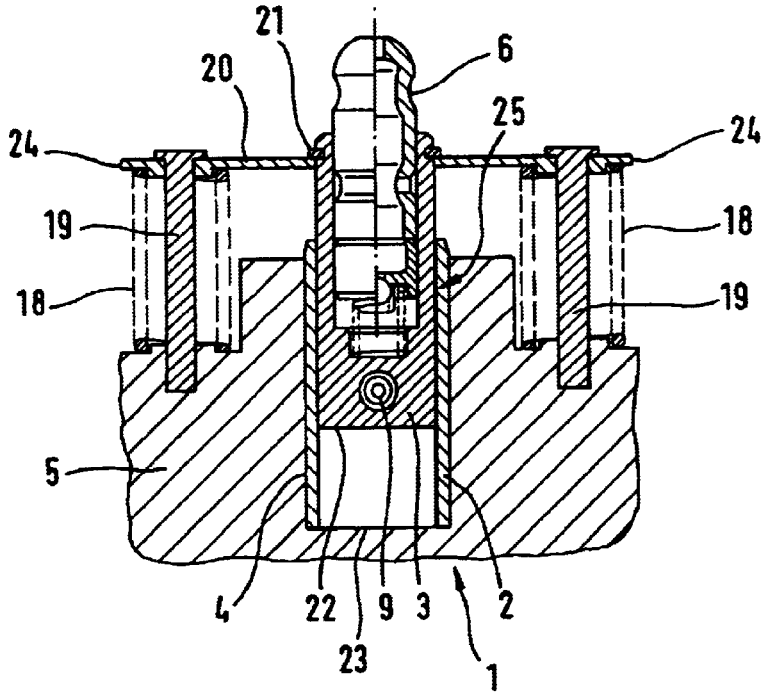
FIG. 2 is a sectional view of an alternative embodiment to that of FIG. 1, having one support element.

In FIG. 2, a person skilled in the art will recognize an alternative embodiment to that of FIG. 1. Two diametrically opposed springs 18 configured as coil or volute springs are shown. Each spring 18 surrounds a guide column 19 that extends parallel to the longitudinal axis of the support element 1 and is fixed in the cylinder head 5. A crossbar 20 connects the guide columns 19 and is pierced through approximately at its center by the head 6 of the inner element 3 of the support element 1. In this example of embodiment, the crossbar 20 surrounds the support element 1 in the manner of spectacles. As can be seen further in FIG. 2, the inner element 3 comprises a driving means 21 that is configured as a separate circlip.

Due to its linear guidance on the guide columns 19, the crossbar 20 can be displaced parallel to the longitudinal axis of the support element 1 towards the cylinder head 5. This embodiment assures a very uniform application of force to the inner element 3.

The inner element 3 must be spaced with its bottom 22 from the bottom 23 of the reception 4 of the cylinder head 5 only to the extent that is required for its lost motion stroke. Additional design space is required for the coupling means 9 which, however, may also be arranged at a different height level of the inner element 3. As can be seen further, the housing 2 is made of a thin-walled light-weight material such as sheet metal.

Figure 3:
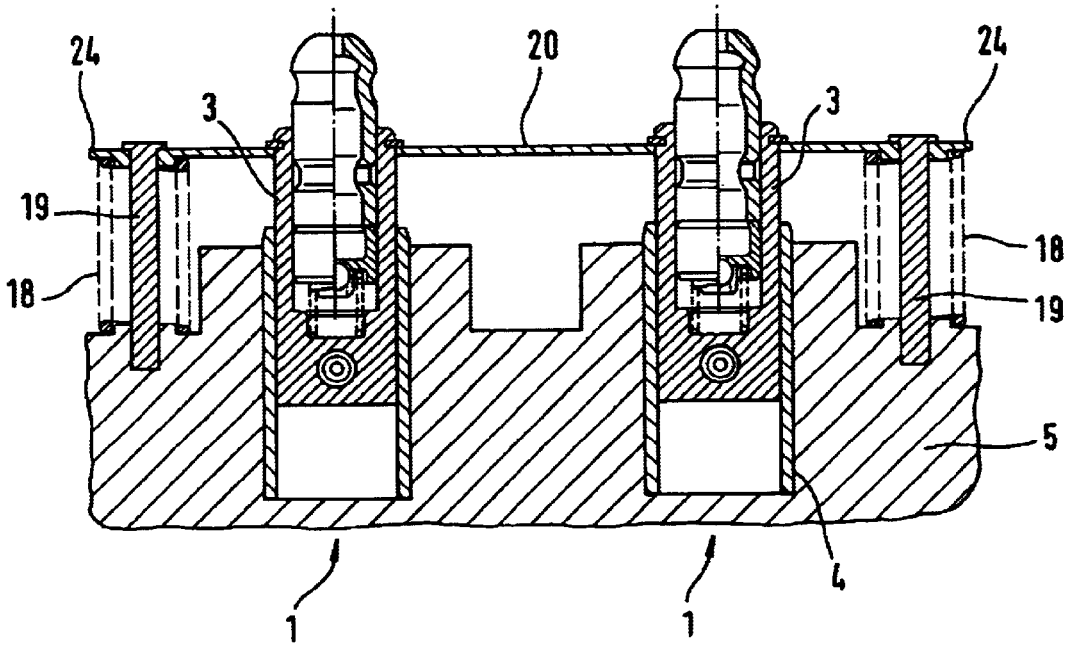
FIG. 3 shows an embodiment similar to that of FIG. 2 but having two support elements.

FIG. 3 shows an embodiment similar to that of FIG. 2 but with the crossbar 20 connecting two support elements 1 in the region of their inner elements 3. Similar to FIG. 2, the guide columns 19 with the springs 18 are arranged at ends 24 of the crossbar 20. If desired, a further spring 18 and a guide column 19 may also be arranged in a central region of the crossbar 20 between the support elements 1.

What is claimed is:

1. A valve train of an internal combustion engine, said valve train comprising one or more switchable support elements that are arranged with an inner element for a relative axial displacement in a reception of a cylinder head of the internal combustion engine, which inner element extends beyond the reception by a head comprising a support for a finger lever, a coupling means for a selective coupling of the inner element relative to the reception in an axially extended state of the inner element out of the reception being associated to the support element, while the inner element is biased away from the reception by at least one spring, wherein the spring is arranged axially offset next to the support element and is coupled to the inner element by a crossbar and the spring is configured as at least one mechanical spring element in form of a coil or flat coil spring and extends on or at least partly in the cylinder head, a guide column being provided as a linear guide for the crossbar parallel to a longitudinal axis of the support element.

2. A valve train of claim 1, wherein the spring surrounds the guide column concentrically.

3. A valve train of claim 1, wherein the inner element of the support element extends approximately centrally through the crossbar, or the crossbar is divided into two aligned legs that enclose the inner element, each end of the crossbar being guided on a guide column.

4. A valve train of claim 1, wherein at least two support elements are loaded by a common crossbar, and the inner elements of the support elements extend through the crossbar or are connected to the crossbar.

5. A valve train of claim 4, wherein at least one end of the crossbar situated outside of the support element is guided on a guide column.

6. A valve train of claim 1, wherein the inner element is arranged for said relative axial displacement directly in a housing that is fixed in the reception of the cylinder head.

7. A valve train of claim 1, wherein the support element comprises a hydraulic adjusting device for valve lash adjustment.

* * * * *